United States Patent [19]

Prudhon et al.

[11] 4,124,353

[45] Nov. 7, 1978

[54] METHOD AND APPARATUS FOR CARRYING OUT A REACTION BETWEEN STREAMS OF FLUID

[75] Inventors: François Prudhon, Saint-Auban; Augustin Scicluna, Salindres, both of France

[73] Assignee: Rhone-Poulenc Industries, Paris, France

[21] Appl. No.: 770,053

[22] Filed: Feb. 18, 1977

Related U.S. Application Data

[63] Continuation of Ser. No. 590,812, Jun. 27, 1975, abandoned.

[51] Int. Cl.[2] ..... F23C 5/00

[52] U.S. Cl. ..... 431/8; 431/173; 431/352

[58] Field of Search ..... 431/9, 8, 10, 173, 158, 431/352, 353; 239/403, 405; 110/28 F

[56] References Cited

U.S. PATENT DOCUMENTS

| | | | |
|---|---|---|---|
| 3,327,762 | 6/1967 | Saha | 431/173 |
| 3,368,604 | 2/1968 | Mutchler | 431/352 X |
| 3,414,362 | 12/1968 | Schoppe | 431/353 X |
| 3,608,309 | 9/1971 | Hill et al. | 431/352 X |
| 3,720,497 | 3/1973 | Arenson | 431/353 X |

*Primary Examiner*—Edward G. Favors
*Attorney, Agent, or Firm*—McDougall, Hersh & Scott

[57] ABSTRACT

The invention concerns a method and apparatus for carrying out a reaction, particularly an exothermic one, between fluids, at a certain distance from the walls, the walls being protected from excessive heating. The apparatus comprises an external casing which is cylindrical or frustoconical, an internal perforated wall which is co-axial with the casing and which bounds the reaction chamber, an axial injection pipe for part of the reagents and a tangential feed pipe for another part of the reagents, the feed pipe imparting a symmetrical helical movement to them. The method is specially applied to the combustion of many different fluids, and the apparatus enables the heat liberated to be directed in a very flexible manner.

13 Claims, 4 Drawing Figures

METHOD AND APPARATUS FOR CARRYING OUT A REACTION BETWEEN STREAMS OF FLUID

This is a continuation, of application Ser. No. 590,812, filed June 27, 1975 abandoned.

The invention relates to a method and apparatus for bringing fluids into contact and making them react together without degrading the walls of the apparatus used. It applies particularly to combustion of various substances and also concerns the burner used.

It is often difficult to prevent the rapid degradation of the parts of a burner unless some components or the walls are protected by a refractory coating. However, some arrangements are known in which this drawback is partially avoided by injecting a large volume of cold, non-combustible gas around the flame. Apart from the fact that these burners are generally designed for a very specific type of combustion they do not completely prevent undesirable deposits on or corrosion of the walls; they are also often difficult to light.

The invention avoids these disadvantages and also makes it possible for combustion to be carried out under variable conditions in one and the same arrangement, possibly with minor alterations. The apparatus is also distinctive in the absence of thermal inertia. The combustion or reaction which has to be carried out can therefore be stopped or started virtually instantly.

The method of the invention brings about a reaction between streams of fluids in a region remote from the walls. It comprises letting a stream of gas, in which no reaction is taking place, into an enclosure of circular section, following helical paths which are symmetrical relative to their common axis and which move around an axial cylindrical region; letting into the said axial region a stream of fluid made up of initially substantially straight paths (hereinafter referred to as the "straight stream") and consisting of substances adapted to react with the substances forming the helical stream and/or with one another; and bringing at least a restricted part of the enclosure, in which the substances adapted to react together are in contact with one another, to a temperature at which the reaction will be initiated.

The method applies particularly to combustion. The combustible substance may enter the reaction vessel as a gas or vapor or as an atomized liquid possibly containing solid particles. It forms at least part of the straight stream. The other part of the stream may be a gas which reacts with the combustible substance and/or which is a vector thereof.

The helical stream may consist either of an inert gas or of gases or vapors adapted to react with the axial straight stream. In the case of combustion, the gas should advantageously be air.

It is also possible, for example, for a mixture of chlorine with liquid, possibly chlorinated, organic hydrocarbons which are atomized by the chlorine to be fed in along the axis of the vessel and for a mixture of ethylene and chlorinated hydrocarbons, which may or may not be saturated, to be introduced in the helical stream. Other reactions may be brought about in a similar way.

The invention also covers the apparatus for carrying out the method described above.

The apparatus comprises an external casing which has a surface of revolution with straight generatrices, i.e. a cylindrical or frustoconical casing; this bounds a chamber which is closed at one end by a substantially flat wall and at least partially open at or near the other end; the apparatus further comprises an internal perforated cylindrical wall which is co-axial with and inside the cylindrical or frustoconical casing and which defines an annular jacket together with the casing; a means for injecting part of the substances in an axial direction through the closed end of the apparatus; and at least one pipe for feeding in the other part of the substances, the pipe being connected to the annular jacket through the external casting, so that the substances conveyed by the pipe enter the jacket at a tangent.

In cases where the external casing is frustoconical, the casing is directed and shaped so that the speed of the gases in the annual chamber is substantially constant, allowing for the outflow through the holes in the perforated surface. The internal cylindrical wall is preferably perforated over a length which is a function of the amount of heat produced and the temperature of the gases, which will be explained below, and over a crown close to the open end of the apparatus, in cases where the tangential pipe for feeding in the helical current cannot be fixed really close to the downstream opening of the apparatus. The perforated wall contains generally circular holes which, at least in the region of the closed end of the apparatus, must be "thin walled, " that is to say, the ratio of the diameter of the holes to the thickness of the wall must be over 5:1; the minimum thickness of the wall is limited only by mechanical considerations. The holes are at least 6 in number and are distributed over at least one circle but preferably over a plurality of director circles of the cylindrical wall. Most of the holes are arranged at the upstream side of the apparatus to encourage mixing of the substances which have to be brought into contact and co-relatively to insure that some of these substances are pre-heated while protecting the internal walls from the thermal effects of the reaction. The total area of holes at the downstream side may be very small, say from 1/10 to 1/100 of the total area of holes.

The ratio of the average section of the annular jacket, perpendicular to its axis, to the total section of perforations is preferably from 5:1 to 15:1, particularly in cases where the external casing is cylindrical.

If $D_1$ is the average internal diameter of the external casing and $D_2$ that of the perforated wall, half $D_1$–$D_2$ is preferably from 1 to 10 on according to the flow rate of the helical stream. The diameter $D_2$ is preferably determined as a function of the total amount of heat liberated in the reaction and is from 0.4 to 0.5 $\sqrt{k}$ mm, $k$ being the number of kilocalories liberated per hour when the combustible substance is burnt or in general by the reaction brought about. $D_2$ should not be less than 500 mm in cases where a viscous reagent, e.g. a heavy fuel, is introduced in the straight stream, and this reagent should preferably be dispersed finely and homogeneously.

The dimensions of the means for supplying the straight axial stream are immaterial. These means are generally in the form of a pipe, at least outside the apparatus, and their function is either to atomize a liquid thoroughly or to let in a gas without any appreciable drop in pressure. They lend themselves to a great many variations. For example, when the combustible substance is liquid, one can advantageously use a nozzle described in applicants' copending application Ser. No. 479,774, filed June 17, 1974, now abandoned and entitled "Process for Contacting Substances which occur in Different Phases" (thereby obviating the need to exert pressure on the combustible substance). Alternatively one can use a simple pipe with a frustoconical outlet and with tubing welded to it outside the apparatus to admit the atomizing gas. The only additional precaution which has to be taken is to avoid using an arrangement which would give a very diverging flow (an angle over 90°) in cases where liquid is introduced. In cases where the combustible substance is a gas, it is often advantageous to protect the wall which forms the closed end of the apparatus with a circular screen. The screen should be smaller in diameter than the perforated wall and arranged parallel with the wall at a distance of 2 to 20 mm; it is itself cooled by the straight stream of gas. A flat cylindrical jacket of a certain thickness may also be provided in communication with the annular jacket outside the closed circular wall of the apparatus. An opening equipped with a convergent frustoconical mouth lets the combustible substance and part of the gas stream supplied through the tangential pipe into the reaction chamber. The pipe supplying the combustible substance opens, downstream, substantially at the level of the flat internal wall of the chamber. It is also possible to allow for the openings around the pipe for injecting the combustible substance to extend through the internal wall.

The flat cylindrical jacket may equally be isolated from the annular jacket and connected to a pipe extending at a tangent or at any inclination to the external wall of the apparatus and supplying the gas mixed with the combustible substance or one of the reagents. In cases where the upstream end of the apparatus has a double wall (screen or cylindrical jacket), the distance *e* between the two walls is preferably from 5 to 20 mm.

The length of the chamber need not be specified. It depends solely on the use to which the heat liberated is put and the conditions imposed by such use.

It is possible to direct the flame (or the reaction gases) towards the region where they are to be used, perpendicularly to the axis of the apparatus, by arranging a tangential pipe in direct communication with the reaction chamber and in the downstream portion thereof. The tangential pipe should point in the reverse direction to the pipe supplying the helical stream, that is to say, so that the stream of gas formed continues its movement as it emerges, without turning back or changing direction.

The reaction chamber is then closed in the downstream direction by a flat wall.

The paths of the helical stream of gas are directed and distributed so as to lower the pressure in the axial portion of the reaction chamber. One result of the lowering of pressure is that the combustible substance is sucked up so that no pressure need be exerted on it except possibly for atomization. Another result is that a substantially straight direction is rapidly imparted to the central core of the stream of fluid introduced through the end of the apparatus.

Another consequence of the existence of the helical stream is that it gives the flame (in the case of combustion) or the reaction zone (generally speaking) a substantially cylindrical shape and prevents the combustible substance from being projected towards the walls. It also causes the flame to be perfectly engaged without other means being provided, even when the axial stream is injected at high speeds, e.g. of about 100 to 150 m/s. Because of the lowering of pressure, particles of hot gas are recycled towards the axis and the flame remains within a cylinder of a radius approximately one third of the radius of the perforated wall. This diameter remains substantially constant whatever the flow rate of combustible substance. On the other hand, the length of that flame varies as a function of the flow rate.

However, it is possible to reduce the radius by arranging a diaphragm at the open end of the chamber or at the level of the region of main perforations. The diaphragm should comprise a circular rim containing an axial opening which determines the diameter of the flame in a ratio close to that defined above.

The stream of gas which is subsequently set in rotation arrives through a tangential pipe; the conditions governing the section of the pipe depend chiefly on the construction of the apparatus and the need to avoid creating excessive loss of pressure; a relative pressure of 0.2 bar is generally sufficient. The aperture connecting the pipe to the annular jacket is preferably near the downstream end of the reaction chamber in the case of a cylindrical chamber, although it may be upstream particularly when the external wall is frustoconical, in which case the smaller end of the chamber is downstream.

The combustible substance is ignited by a conventional means, such as a plug, with a spark flashing between its electrodes. The plug may be mounted on a retractable device comprising e.g. a metal bellows. The spark is produced in a region where the combustible substance and the combustion-supporting substance are in contact, then the lighting means can be withdrawn to the level of the perforated wall. It is obviously also possible to ignite the mixture or to initiate the reaction with a flame.

Due to the above-mentioned advantage concerning the temperature of the walls, it is possible to make the apparatus of ordinary steel. There is no point in using stainless steel or other corrosion-resistant metals except when the presence of any oxide dust has to be avoided. It is quite unnecessary to provide refractories.

It is an advantage for the tangential stream to enter the reaction chamber from the annular jacket at a speed of 15 to 50 m/sec., assuming the flow of gas to be normal to the cylindrical wall and calculating it normal to the holes. The gas does in fact flow with a certain angle of incidence which is necessary to produce the helical movement and the lowering of pressure in the central core, where the flame is propagated. In the case of combustion, the helical stream usually consists of air. It is obviously necessary to respect the speed limit mentioned above and to carry out the whole of the desired reaction; within these limits the quantity of one component of the mixture may vary, enabling the temperature of the hot gases to be adjusted for the same quantity of combustible substance.

The combustible substance may be a gas such as methane or propane or another light hydrocarbon, liquid residues which have to be destroyed by combustion, possibly with tars or soot in suspension, or a material which is solid at ambient temperature and which is melted before injection, such as sulphur. Other substances of many different types may also be injected to undergo a specific reaction.

The application of the method is explained below with a more detailed description of the apparatus in which reference is made to the accompanying drawings. The drawings should not be considered as restricting the invention but as illustrating the forms which it may take. In the drawings.

Figure 3:
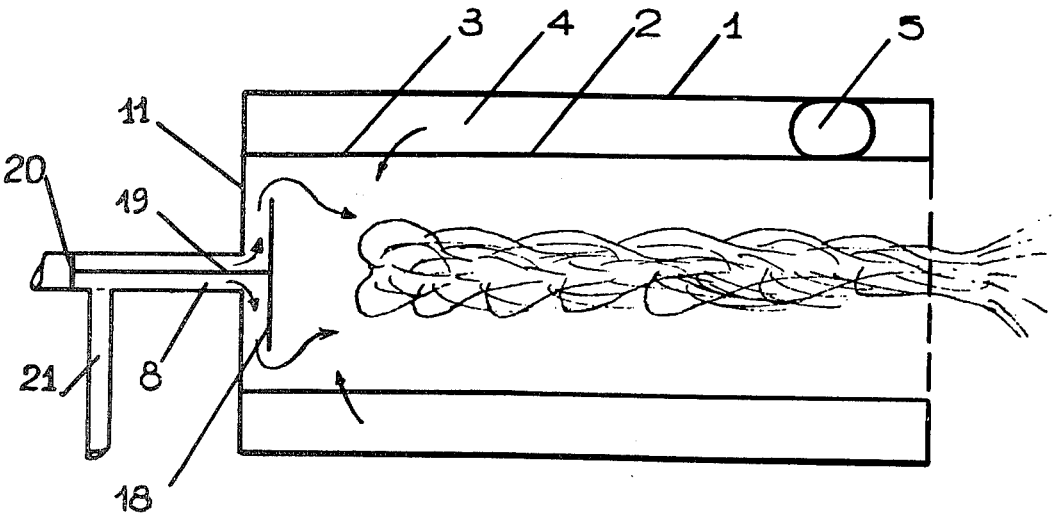
FIG. 3 is a section through a different embodiment of the apparatus, taken along its axis.

The apparatus, which will be described chiefly with reference to its use as a burner, comprises an external casing 1 and a perforated internal wall 2 containing holes 3. These two walls define the annular jacket 4 into which a stream of gas is passed through the tangential pipe 5. Inside the wall 2 is the combustion chamber 6. This is closed at one end by a wall 7 through which a fuel injecting pipe 8 extends, and the chamber has an aperture 9 to receive air which will support the combustion. The air comes from the cylindrical chamber 10 between the wall 7 and a second, external wall 11 parallel with the first. It is sent into the chamber through a pipe 12, which is shown in a tangential position in FIG. 3 although it may have any inclination to the external cylindrical surface of the chamber 10. The sparking plug 13, which initiates combustion, passes through the walls of the chamber and may be withdrawn after ignition. Optional diaphragms 14 and 15, provided with central apertures 16 and 17 which define the diameter of the flame, are arranged approximately in the center of the chamber and at its outlet respectively. The helical stream follows substantilly the path represented by the continuous-line arrows and keeps the flame in a substantially cylindrical volume as far as the aperture 17, after which the flame diverges. The holes around the fuel injecting pipe 8 and the wall containing them are not shown in FIG. 3, which does show the protective screen 18. This is held by a bar 19 which is itself fixed in the pipe 8 by a cross-piece 20. The stream of gas to support combustion is let in through the tube 21. The mixture of combustion-supporting gas and fuel, which must be essentially gaseous in such an apparatus, passes into the reaction chamber by moving round the screen 18 before moving in a generally straight direction in the central core.

Figure 4:
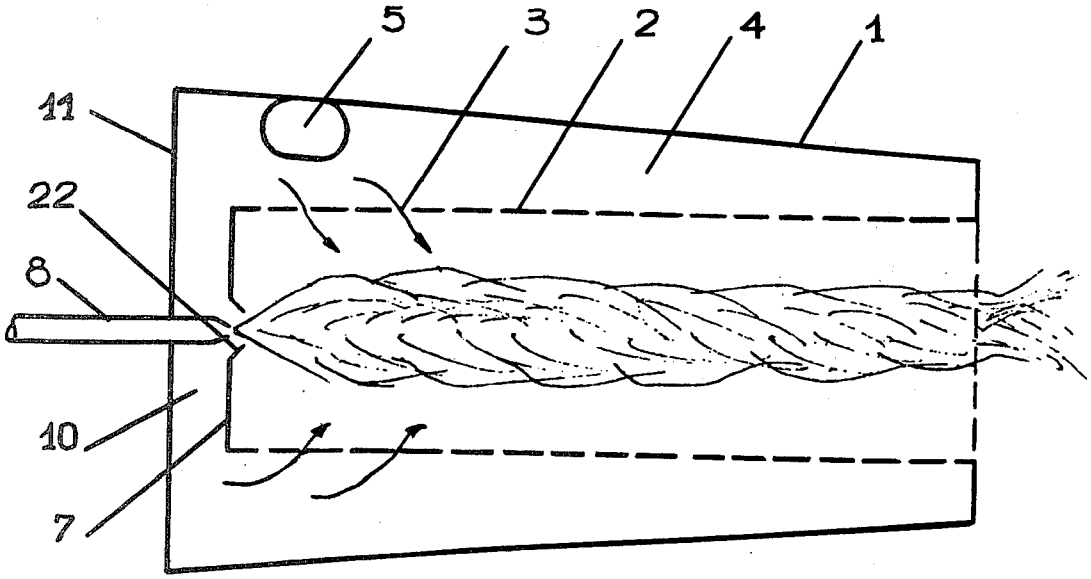
FIG. 4 is a section taken along the axis of a final embodiment.

Another embodiment is illustrated in FIG. 4. This shows an apparatus with only one pipe 5 for introducing combustion-supporting, diluting gas, and with a cylindrical chamber 10 which communicates with the annular chamber 4, the chamber 4 having a frustoconical external wall 1. The pipe 5 may then be located towards the upstream end of the arrangement (in which case the wall 2 may be perforated throughout its length), thus allowing for any atomization of the fuel by part of the gas introduced at 5. The fuel injection pipe 8 reaches the level of the converging mouth in the center of the wall 7. An apparatus of this type may be used for either gaseous or liquid fuels.

Figure 1:
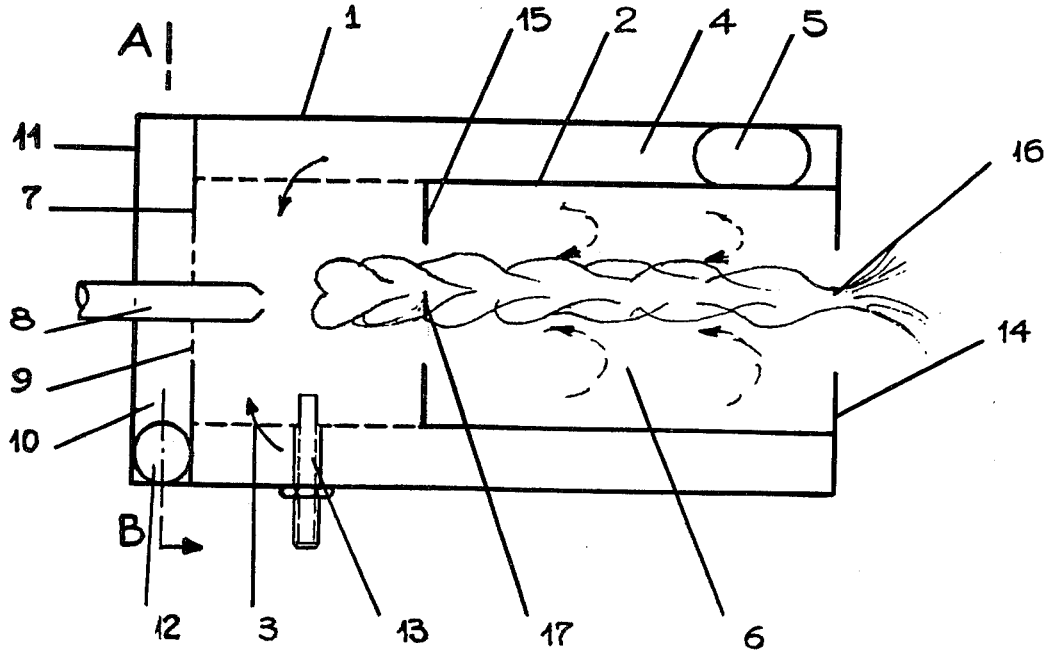
FIG. 1 is a section through the apparatus according to the invention, taken along the axis thereof.
Figure 2:
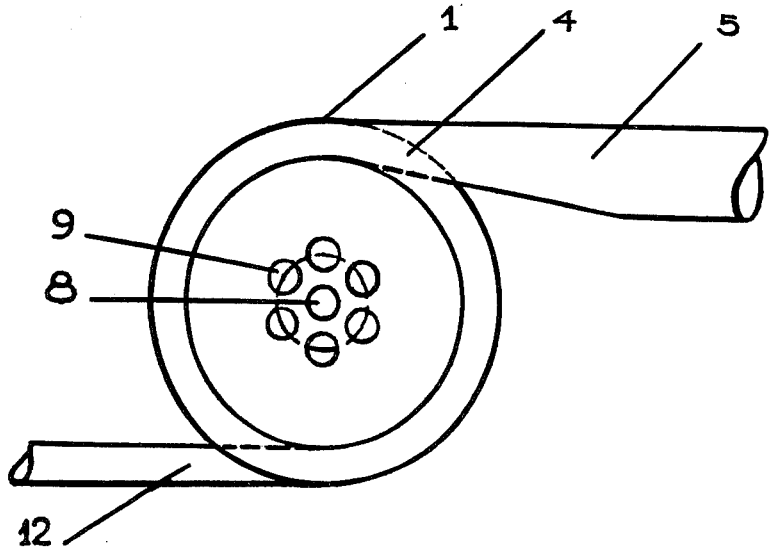
FIG. 2 is a section through the same apparatus taken along the line A–B of FIG. 1, with the fluid intake pipes projected onto the plane of the figure.

A burner as shown in FIG. 1, with a total length of 45 cm, a casing with an internal diameter of 30 cm, a perforated wall 5 mm thick and 30 cm in internal diameter with 75 holes 20 mm in diameter distributed at the upstream side and a mesh of 5 × 5 cm and 12 holes 8 mm in diameter distributed over a directrix near the downstream opening of the apparatus, is fed with 100 m3/h of methane and 3,000 m3/h of air measured at normal temperature and pressure, will give gases at 800° C. on discharge from the burner. The perforated cylindrical wall will be at 150° C. and the external casing at 60° C.

Apart from its simplicity and the absence of thermal inertia, which enables the apparatus to be stopped and restarted almost instantly, the particular advantage of such an arrangement is that it enables the desired reaction or combustion to be carried out under pressure. Wide variations can also be obtained, e.g. in the quantity of air introduced for combustion as well as the nature and quantity of the fuel and of the hot gas produced, and thus its temperature, while still remaining within the limits of inflammability. The extremely low thermal inertia makes it possible to adopt a simple, reliable system for controlling combustion, such as a thermocouple with its weld level with the wall of the combustion chamber. The thermalcouple may control an electric valve which instantly interrupts the intake of fuel.

We claim:

1. A method for carrying out a reaction between fluid streams, at least one of which is in a vapor or gaseous state, in a reaction zone defined by a cylindrical wall, in which the reaction is carried out in a region remote from said wall, comprising introducing a fluid stream of one of the reactants into the reaction zone for axial flow from an inlet at one end of the reaction zone toward an outlet at the other end, introducing the stream of fluid in the vapor or gaseous state for helicoidal symmetrical flow about the outside of the cylindrical wall in the direction towards the inlet end, causing most of the gas in helicoidal flow to flow through openings in the wall adjacent the inlet for continued flow into and through the reaction zone in helical paths about the axial stream and in the same axial direction, enabling the fluid of the axial stream to intermix with vapor or gas from the adjacent portion of the helical stream during continued flow through the reaction zone for reaction while the helical stream confines the reaction to a region remote from the wall.

2. The method of claim 1 characterized in that the fluid introduced for axial flow comprises a combustible substance and the fluid introduced for helical flow comprises at least part of the combustion-supporting gas required to burn the said combustible substance.

3. The method of claim 1 characterized in that the fluid introduced for axial flow is a liquid which is homogeneously atomized at a distance from the walls.

4. Apparatus for carrying out a reaction between streams of fluid at least one of which is a fluid in a gaseous or vapor state comprising a reaction chamber defined by a cylindrical inner casing closed at one axial end except for an inlet and at least partially open at the other outlet axial end portion, an outer casing spaced from the inner casing to define an annular space therebetween, passages through the inlet end portion of the inner casing communicating the annular space with the reaction chamber, means for introducing a reactant fluid through the inlet for flow in an axial direction from the inlet towards the outlet through the reaction chamber, an inlet means to the outer casing located downstream of the inlet end of the inner casing means for introduction of the fluid in the gaseous or vapor state tangentially through the inlet means into the annular space whereby said fluid flows in helical current about the outside surface of the inner casing and up to and through the passages for continued flow in helical current between the axial stream and the inner casing down about the outer portion of the space defined by the inner casing.

5. The apparatus of claim 4 in which the outer casing is of frustoconical shape with the base of larger diameter at the inlet end portion.

6. The apparatus of claim 4, characterized in that half the difference between the internal diameter of the outer casing and of the inner casing is from 1 to 10 cm, and that the internal diameter of the inner casing is from 0.4 to 0.5 $\overline{vk}$ mm, $k$ being the number of kilocalories liberated hourly by the reaction brought about.

7. The apparatus of claim 4, which includes a circular screen, smaller in diameter than the inner casing arranged in special parallel relation with the wall at the closed end of the reaction chamber.

8. The apparatus of claim 4, which includes a cylindrical jacket 5 to 20 mm thick beyond the closed end wall of the reaction chanber, the wall then being provided with perforations arranged symmetrically relative to the axis of the apparatus.

9. The apparatus of claim 4, which includes a diaphragm comprising a rim with an axial circular opening at the open outlet end of the inner casing.

10. The apparatus of claim 4, which includes a diaphragm with an axial circular aperture across an intermediate portion of the chamber between the inlet end and the outlet end.

11. The apparatus of claim 4, which includes a tangential pipe directly connected to the reaction chamber, near the end of the chamber opposite the inlet for the axial stream, the tangential pipe pointing in the reverse direction to the inlet for the helical stream and the reaction chamber.

12. Apparatus as claimed in claim 4 in which the means for introducing the reactant fluid comprises a nozzle.

13. Apparatus as claimed in claim 7 in which the circular screen is spaced from the wall by an amount within the range of 2 to 20 mm.

* * * * *